United States Patent [19]

Toma et al.

[11] Patent Number: 4,817,297

[45] Date of Patent: Apr. 4, 1989

[54] FABRIC DRYER SUPPORT STRUCTURE

[75] Inventors: Daniel N. Toma, Georgetown, Ind.; Thomas P. Mitchell, Louisville, Ky.

[73] Assignee: General Electric Company, Louisville, Ky.

[21] Appl. No.: 132,872

[22] Filed: Dec. 14, 1987

[51] Int. Cl.[4] ..... F26B 11/04

[52] U.S. Cl. ..... 34/133; 34/139

[58] Field of Search ..... 34/133, 130, 132, 134, 34/139, 138, 235, 82

[56] References Cited

U.S. PATENT DOCUMENTS

| | | | |
|---|---|---|---|
| 3,487,556 | 3/1968 | Patrick | 34/133 |
| 3,892,048 | 7/1975 | Jacobsen, Jr. | 34/133 |
| 4,088,017 | 5/1978 | Olges | 78/168 |
| 4,586,269 | 5/1986 | St. Louis | 34/133 |
| 4,720,925 | 1/1988 | Czech et al. | 34/133 X |

*Primary Examiner*—Henry A. Bennet

*Attorney, Agent, or Firm*—Radford M. Reams; Frederick P. Weidner

[57] ABSTRACT

A fabric dryer support structure serves multiple functions and facilitates dryer assembly. The dryer includes a drum, a panel supporting the open front end of the drum and a housing having front panel spaced from the open end of the drum. A unitary intermediate member bridges between the front panel and the drum, with an opening in the intermediate member in register with an access opening in the front panel and the open front end of the drum. A rim on the intermediate member is closely aligned with the front edge of the drum. The intermediate member also supports a filter in alignment with part of the drum opening.

10 Claims, 4 Drawing Sheets

FABRIC DRYER SUPPORT STRUCTURE

BACKGROUND OF THE INVENTION

Typical automatic clothes dryers include a drum rotatable about a substantially horizontal axis in which clothes and other fabrics to be dried are placed. During operation air is heated, either electrically or by gas, and passed through the drum while the drum is rotated to tumble the clothes. The air passing through the drum subsequently passes through a filter to remove lint and then is vented to the outdoor atmosphere. Normally the drum is mounted in a housing with the open front of the drum spaced from the front panel of the housing. The drying air normally flows from the back to the front of the drum, after which it passes through the filter, mounted at the front of the housing for ease of cleaning by the user. With such a construction it is necessary to include a member to seal the space between the front of the drum and the front panel of the dryer housing. The seal must be concentric with the drum and must not provide any cracks or openings which can catch fabrics being tumbled in the drum. It is also necessary to provide a mounting structure for the filter. Normally the filter either is spaced from the front edge of the drum or overlies a part of the drum front with a grill interposed in front of the filter to prevent contact of the fabrics with the filter.

It is desirable to provide these functions by means of a unitary structure which fully meets the requirements of each of the functions and at the same time facilitates automatic dryer assembly for minimizing production costs.

By our invention there is provided a clothes dryer support structure including a seal support structure which performs multiple functions, is unitary in construction and facilitates automatic assembly.

SUMMARY OF THE INVENTION

In accordance with one form of the invention there is provided a fabric dryer including a housing having a rear panel, a pair of spaced apart side panels and a front panel. The front panel includes an inwardly projecting flange defining an access opening for the dryer. A drum is mounted in the housing for rotation about a generally horizontal axis and includes a front flange spaced from the front panel and defining a drum opening generally aligned with the access opening. A support panel is positioned rearwardly of the front panel and supports the front of the drum. A unitary seal support structure or intermediate member bridges between the front of the drum and the front panel. An opening in the intermediate member fits around the flange in the front panel. The intermediate member also includes a sealing rim closely aligned and concentric with the drum front flange. The intermediate member further includes mounting means supporting a filter in alignment with a portion of the drum front opening. The front panel includes a front wall and a pair of spaced apart, inwardly projecting lips positioned rearwardly of the front wall. The intermediate member includes a plurality of resilient tabs received between the front wall and the lips for connecting the intermediate member to the front panel. The intermediate member includes a spaced apart tapered dowel and a curved lip. The support panel includes an opening in which the dowel is received and an opening for passage of air exiting the drum. The curved lip is received in the air passage opening. This positions the intermediate member relative to the support panel.

Some aspects of the illustrative fabric dryer shown and described in the present application are common with copending application Ser. No. 07/1132,871, filed Dec. 14, 1987 for Daniel N. Toma and assigned to General Electric Company, assignee of the present invention. However the inventions claimed in these applications are separate and distinct.

DESCRIPTION OF THE PREFERRED EMBODIMENTS

Figure 1:
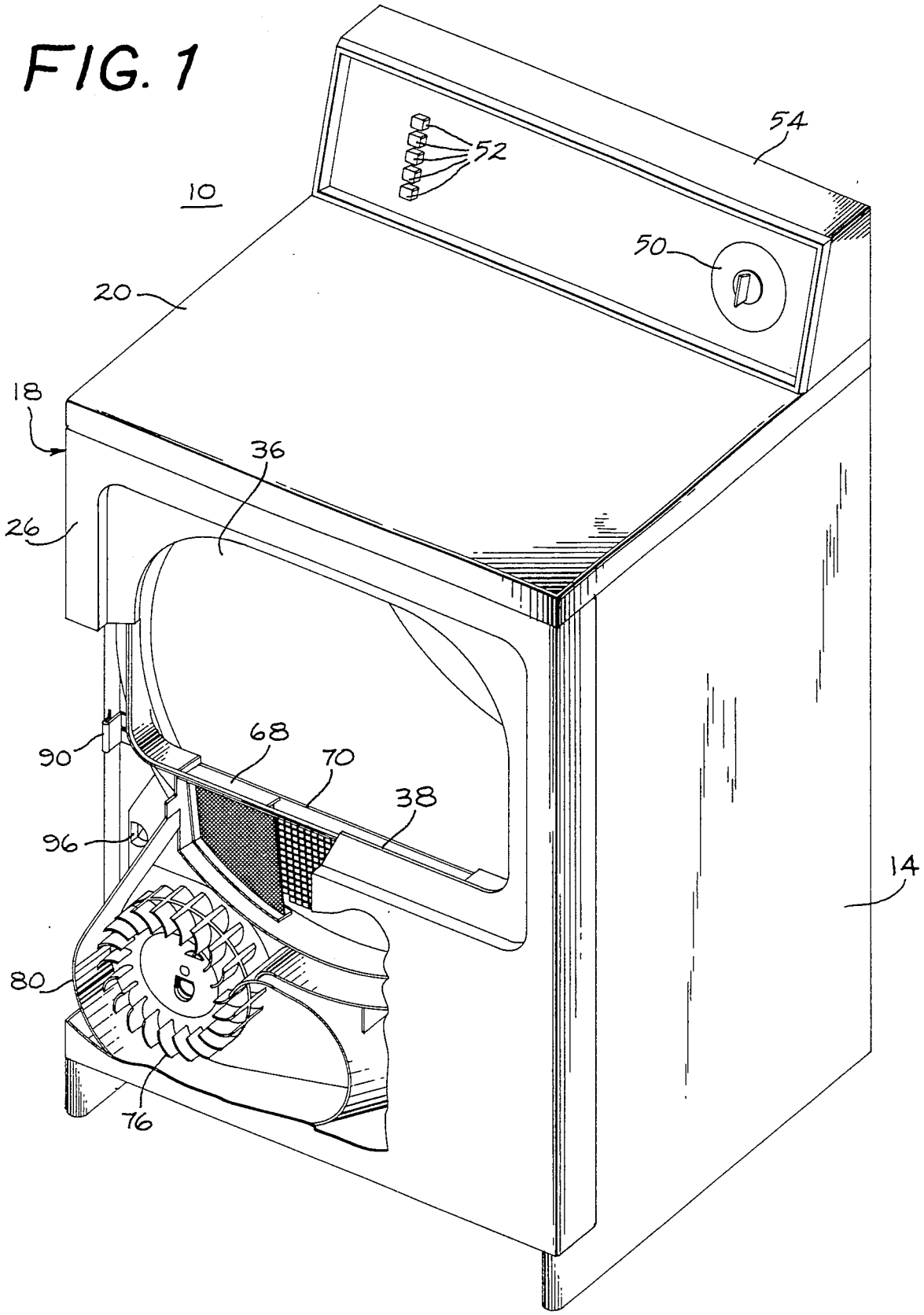
FIG. 1 is a front perspective view of a clothes dryer incorporating one form of present invention, the view being partly broken away to illustrate details and somewhat schematic for ease of reference.

Referring now to the drawings, there is illustrated a domestic fabric or clothes dryer generally indicated by the numeral 10. The dryer 10 is provided, in the usual way, with a housing or cabinet having a rear panel 12, a pair of spaced apart side panels 14 and 16, a front panel 18, a top 20 and a bottom pan 22. Conventionally the rear and side panels may be formed by bending a continuous sheet of metal. The front panel is formed as a separate member and may in fact be slightly shorter than the rear and side panels so as to be mounted on a spacer 24 at the front of the bottom pan 22. This provides room, normally called a kick space, below the front panel.

Figure 2:
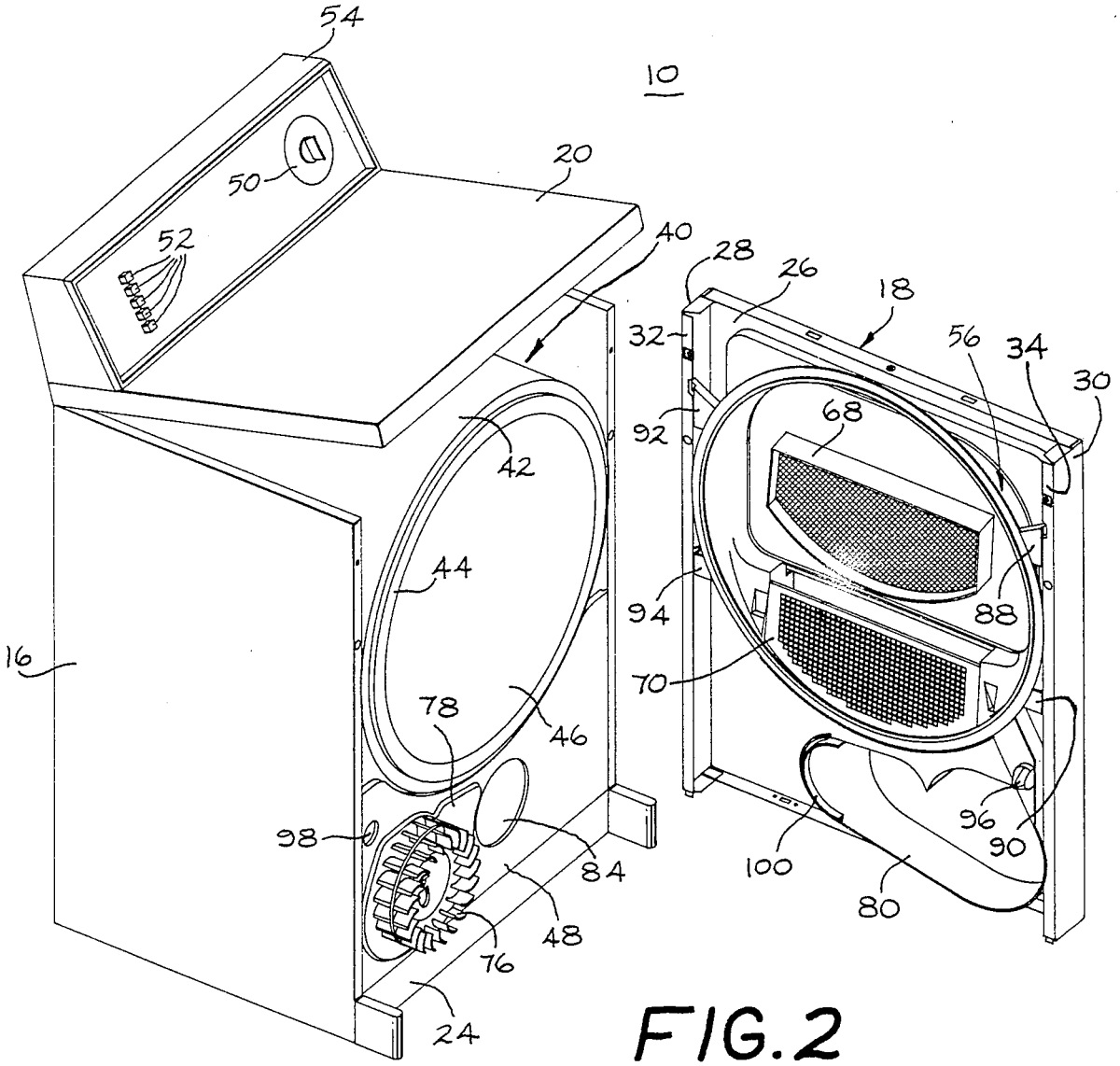
FIG. 2 is a somewhat schematic, front perspective view of the clothes dryer of FIG. 1 with the front panel of the housing folded out.
Figure 3:
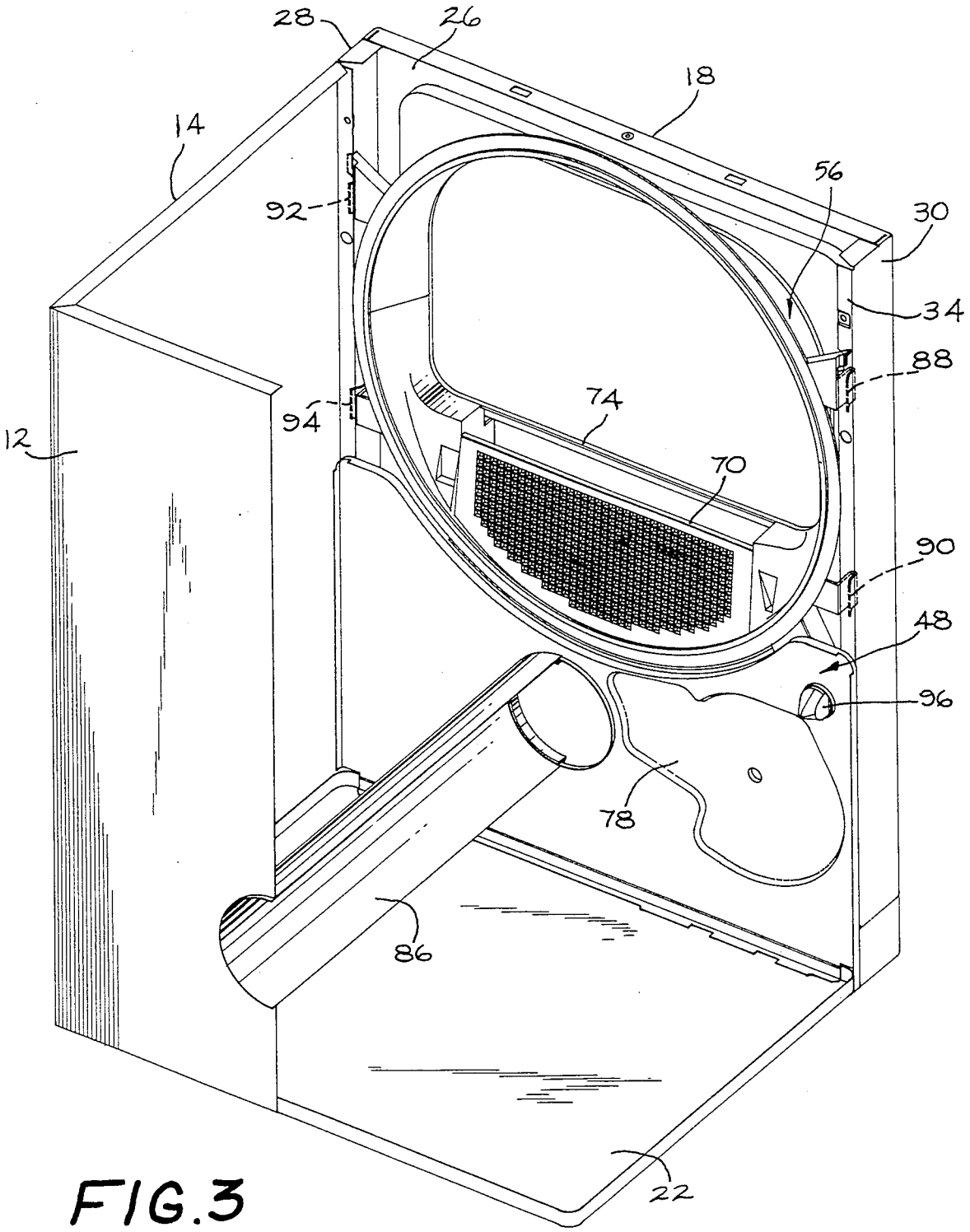
FIG. 3 is a somewhat schematic, rear perspective view of the housing for the dryer of FIG. 1 with the top removed and the view being partly broken away and partly in section to illustrate details.
Figure 4:
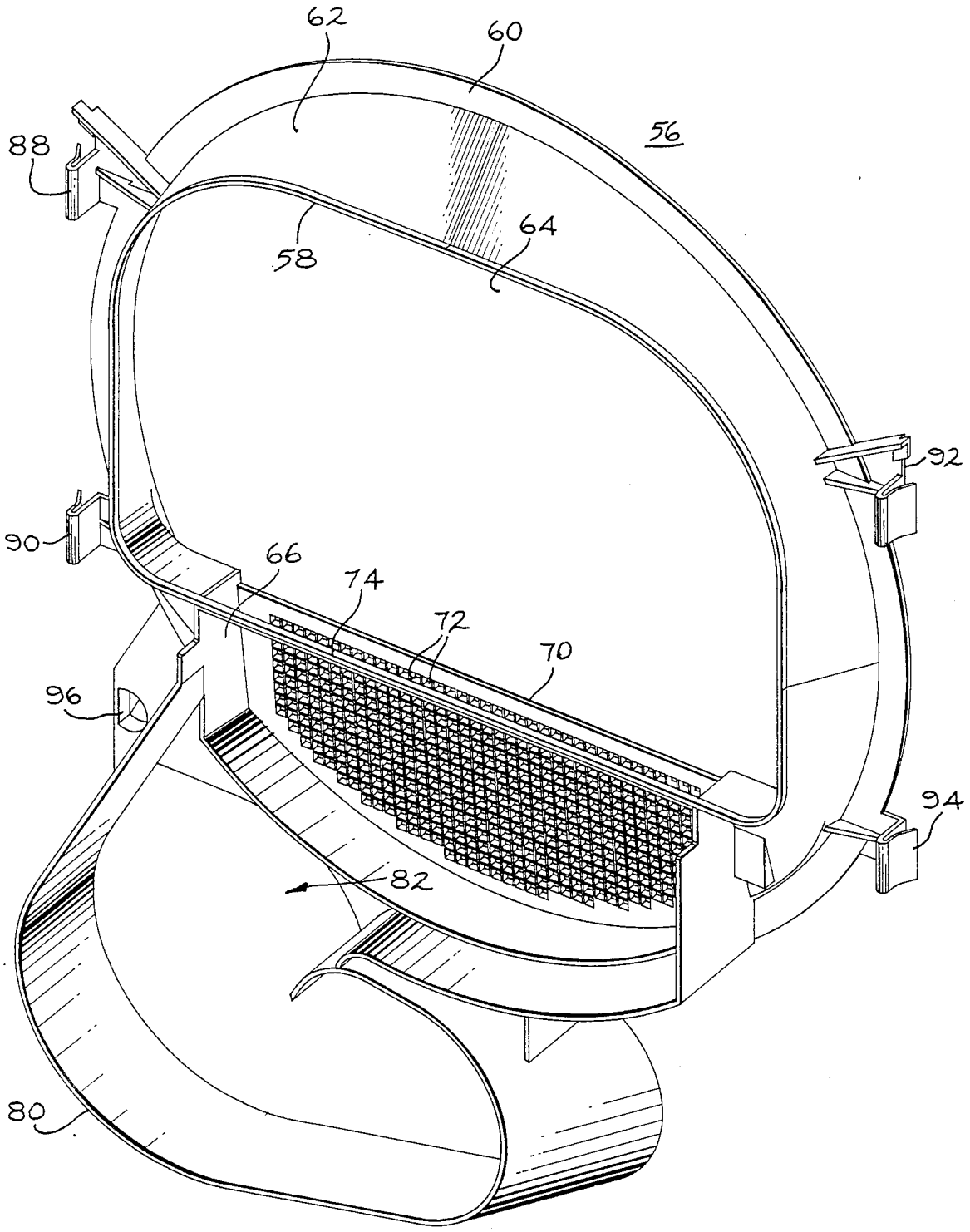
FIG. 4 is a perspective view of the unitary seal support structure of the dryer of FIG. 1.

As best seen in FIGS. 2 and 3, the front panel includes a front wall 26 and a pair of rearwardly projecting side flanges 28 and 30. Each of the side flanges terminates in an inwardly projecting lip 32 and 34 respectively. The front wall 26 is formed with an opening 36 surrounded by flange 38 to provide access to the interior of the machine. A door normally mounted on the front wall 26 to selectively close the opening 36 has been omitted from the drawings for sake of simplicity.

A fabric tumbling chamber or drum 40 is mounted for rotation around a substantially horizontal axis within the dryer housing. The drum 40 is generally cylindrical in shape, having animperforate outer cylindrical wall 42 and a front flange or wall 44 defining a drum opening 46. When the dryer is assembled, the drum opening 46 registers with the opening 36 in the front panel of the housing, permitting clothes or other fabrics to be loaded into and removed from the dryer. A plurality of clothes tumbling ribs (not shown) normally are provided on the interior of the wall 42 to lift fabrics and then allow them to tumble back to the bottom of the drum as the drum rotates.

The drum 42 conventionally includes a rear wall (not shown) which is rotatably supported within the cabinet by a suitable fixed bearing means. The front of the drum is rotatably supported by support panel 48 which is mounted within the cabinet just behind the front flange 44. Conventionally rollers or slides of low friction material (not shown) are mounted on the panel 48 and rotatably support the front of the drum. The drum 40 terminates rearwardly of the front wall 26 and thus the support panel 48 is mounted within the cabinet rearwardly of the front wall 26. In the illustrative embodiment the panel 48 is mounted in alignment with the front edges of the side panels 14 and 16 and is attached to them and to the bottom pan 22 to contribute structural strength and stiffness to the housing. Conventionally air for drying the fabrics is heated either by electrical resistance heaters or by a gas fueled heat exchanger. A blower draws the heated air through the drum to evaporate moisture from the fabrics in the drum and then expels the hot moist air out of the housing and through a conduit to the outside atmosphere. As the heated air is drawn through the drum the drum is rotated, conventionally by means of an electric motor. The operation of these various components are controlled by control means such as the timer 50 and switches 52 mounted in the backsplash 54 at the rear of the top panel 20. These various operating components are conventional in nature and have been omitted for the sake of simplicity.

The space between the front flange 44 of the drum 40 and the front wall 26 is bridged by a unitary seal support structure or intermediate member 56. The intermediate member includes a D-shaped flange 58, dimensioned to fit closely around the flange 38 defining the opening 36 through the front wall 26, and a circular sealing rim 60. The sealing rim 60 is dimensioned to closely abut and be coextensive with the front flange 44 of drum 40. The rim 60 may rub directly against the flange 44 as the drum 40 rotates or, if desired, a low friction gasket material may be attached to the rim 60 to engage the flange 44. A circumferential wall or baffle 62 extends between the flange 58 and rim 60 to provide a substantially continuous baffle between front wall 26 and drum 40. Thus, when the intermediate member is mounted in the dryer between the front wall 26 and drum 40, an opening 64 provides the user access to the interior of the drum for inserting or removing clothes and other fabrics. At the same time, the circumferential edge of this opening is substantially blocked by baffle 62, preventing the inadvertent passage of fabrics out of the drum into the working area of the dryer. The lower portion of the baffle 62 is formed as a pocket 66 to receive and support a lint filter 68. A grill 70 extends across the face of the pocket 66 exposed to the interior of the drum and includes relatively large air passages 72. A strengthening bar 74 extends across the opposite side of the pocket 66. The filter 68 is received in the pocket and confined by the grill 70 and bar 74. During operation air flowing through the drum 40 then flows through the grill 70 and filter 68 as it exits the dryer. Since the air passages 72 through the grill are relatively large they do not trap lint and thus the grill protects the fabrics being dried from rubbing against the filter and picking up lint which has been filtered out of the air stream.

In order to move air through the dryer a blower wheel is mounted for rotation adjacent an embossed or raised area 78 of the support panel 48. The blower wheel 76 is rotated by an electric motor, not shown, mounted on the opposite side of the support panel. Intermediate member 56 includes an arcuate wall 80 shaped to conform to the edge of embossed portion 78. The arcuate wall extends between and tightly butts against the support panel 48 and the front wall 26 of front panel 18 and, together with them, forms the housing for the blower incorporating blower wheel 76. The arcuate wall 80 is discontinuous at 82 providing an opening for air entering the blower and the support panel 48 is provided with an opening 84 for air exiting the blower. Air exiting the blower through the opening 84 is conducted by a conduit 86 to the rear of the dryer so that it may be exhausted to the outside atmosphere. Details of the construction and operation of the blower may be had by reference to co-pending application Ser. No. 07/132,871.

The intermediate member or seal support structure 56 is constructed for ease of mounting while, at the same time, assuring that it has the proper relationship to the front panel 18, the drum 40 and the support panel 48. To this end the intermediate member 56 is formed with four flexible tabs or tangs 88, 90, 92 and 94 respectively and a tapered dowel or pin 96 and the arcuate wall 80 includes a curved lip 100. The support panel 48 is formed with a mounting hole 98 sized to fit closely around the dowel 96.

When the dryer is assembled the intermediate member 56 is first mounted on the front panel 18 with the flange 58 of the intermediate member 56 fitting around the flange 38 of the front panel 26, with the four tabs 88–94 captured between the front wall 26 and the lips 32 and 34 and with the ends of the tabs confined by the side flanges 28 and 30. This provides a correct general alignment of the intermediate member 56 and supports it for final assembly to the dryer. The front panel then is attached to the front edges of the side panels 14 and 16 by any suitable means such as screws. As the front panel comes into contact with the sides panels the dowel 96 enters the opening 98 and the lip 100 enters the opening 84 and seats against the edge of the intermediate panel 48 defining the opening 84. This provides the final alignment of the intermediate member 56 relative to the support panel 48 and the drum 40 so that the arcuate wall 80 properly fits about the impeller 76 and the rim 60 is contiguous with the front flange 44 of the drum 40.

It is advantageous that the intermediate member 56 be of a unitary construction. Conveniently it could be molded in one piece of a suitable plastic material such as talc filled polypropylene or molded in several pieces which are then permanently formed to join a unitary structure.

The foregoing is a description of a preferred embodiment of the invention. In accordance with the patent statutes, changes may be made in the disclosed construction and the method in which it is employed without actually departing the true spirit and scope the invention as defined in the appended claims.

What is claimed is:

1. A fabric dryer including:

a housing having a rear panel, a pair of spaced apart side panels jointed to said rear panel and a front panel removably mounted for closing the space between the front edges of said side panels;

said front panel including a front wall and a pair of rearwardly projecting side flanges, each of said side flanges terminating in an inwardly projecting lip; said front wall including a flange defining an access opening therein;

a clothes receiving drum mounted in said housing for rotation about a generally horizontal axis, said drum having a front flange defining a drum opening generally aligned with the access opening in said front wall; and a separate intermediate member bridging between the front of said drum and said front wall around the access opening, said intermediate member defining an outlet opening for exit of air from said drum and forming a mount for an exit air filter, said intermediate member including a flange fitting around said flange in said front wall and a plurality of resilient tabs received between said front wall and said inwardly projecting lips for connecting said intermediate member to said front panel.

2. A Fabric dryer as set forth in claim 1, further including a support panel positioned rearwardly of said front wall to support the front of said drum; each of said support panel and intermediate member including means cooperating to position said intermediate member relative to said support panel.

3. A fabric dryer as set forth in claim 2 wherein said cooperating means including a locating opening, formed in one of said support panel and said intermediate member, and a dowel formed on the other of said support panel and said intermediate member and closely fitting in said locating opening for positioning said intermediate member relative to said support panel.

4. A fabric dryer as set forth in claim 3 wherein said dowel is tapered to assure proper mating of said support panel and said intermediate wall.

5. A fabric dryer as set forth in claim 2 wherein: said support panel defines an outlet opening for passage of air exiting from said drum, and said intermediate member includes a curved lip received in said outlet opening to form at least part of said means to position said intermediate member relative to said support panel.

6. A fabric dryer including:

a housing having a rear panel, a pair of spaced apart side panels and a front panel; said front panel including a flange defining an access opening therein;

a clothes receiving drum mounted in said housing for rotation about a generally horizontal axis, said drum having a front flange spaced from said front panel and defining a drum opening generally aligned with the access opening in said front panel;

an unitary intermediate member bridging between the front of said drum and said front panel, said intermediate member defining an opening therein sized to fit around said flange in said front panel, said intermediate member further including a sealing rim sized to be closely aligned and concentric with said drum front flange, and said intermediate member further including mounting means for supporting a filter in alignment with a portion of the drum opening;

;said front panel and said intermediate member including means cooperating to generally position said intermediate member relative to said front panel with said front panel flange in said opening in said intermediate member; and a support panel positioned rearward of said front panel to support the front of said drum;

said support panel and said intermediate member including means cooperating to finally position said intermediate member relative to said support panel with said sealing rim closely aligned with said drum front flange.

7. A fabric dryer as set forth in claim 6, wherein said means cooperating between said support panel and said intermediate member includes a locating opening, formed in one of said support panel and said intermediate member, and a dowel, formed on the other of said support panel and said intermediate member and closely fitting in said locating opening for positioning said intermediate member relative to said support panel.

8. A fabric dryer as set forth in claim 7, wherein said dowel is tapered to assure proper mating of said support panel and said intermediate wall.

9. A fabric dryer as set forth in claim 7 wherein said support panel defines an outlet opening for passage of air exiting from said drum and said intermediate member includes a curved lip received in said outlet opening to form at least part of said means to position said intermediate member relative to said support panel.

10. A fabric dryer as set forth in claim 6, wherein said front panel including a front wall and a pair of spaced apart, inwardly projecting lips positioned rearwardly of said front wall and said intermediate member includes a plurality of resilient tabs received between said front wall and said lips to form said means cooperating to generally position said intermediate member relative to said front panel.

* * * * *